US005927110A

United States Patent [19]

Yu

[11] Patent Number: 5,927,110

[45] Date of Patent: Jul. 27, 1999

[54] ZIPPER LOCK WITH A SLIDABLE BUTTON AND A COMBINATION LOCKING DEVICE

[76] Inventor: Chun-Te Yu, P.O. Box 55-175, Taichung, Taiwan

[21] Appl. No.: 08/964,401

[22] Filed: Nov. 4, 1997

[51] Int. Cl.[6] ..... E05B 67/38

[52] U.S. Cl. ..... 70/68; 70/312; 70/69; 70/316

[58] Field of Search ..... 70/312, 68, 304, 70/69, 70–72, 74–76, 315, 317, 316

[56] References Cited

U.S. PATENT DOCUMENTS

| | | | |
|---|---|---|---|
| 4,155,234 | 5/1979 | Bako | 70/312 |
| 4,756,173 | 7/1988 | Yang | 70/68 |
| 4,974,432 | 12/1990 | Blake | 70/68 |
| 5,103,657 | 4/1992 | Horita et al. | 70/68 |
| 5,557,954 | 9/1996 | Ling | 70/312 |
| 5,689,979 | 11/1997 | Yu | 70/312 |

*Primary Examiner*—Darnell M. Boucher
*Attorney, Agent, or Firm*—Harrison & Egbert

[57] ABSTRACT

A zipper lock with a slidable button and non-disturbance code of combination locking device is provide. The lock includes a casing having an opening in forward end for slidably securing a rearward slidable button, a pair of first and second latch members rotatably secured to a fore portion each having a tongue toward each other for locking up a pair of tabs from a double zipper, a slide operated in cooperation with a combination locking device and a check member which checks the latch member from rotation. This disclosure is characterized in the simplized locking mechanism, the rearward slidable button and the check member which gives possibility to control the combination locking device for preventing the code from disturbed by inadvertent rotation of the dials and facilitating the users to change their desired code for the combination locking device.

9 Claims, 10 Drawing Sheets

ZIPPER LOCK WITH A SLIDABLE BUTTON AND A COMBINATION LOCKING DEVICE

TECHNICAL FIELD

The present invention relates to zipper locks and more particularly to an improved zipper lock attached to an opening of a suitcase for locking the tabs of a double zipper on the opening of the suitcase, which lock includes a rearward slidable button operable in cooperation with a non-disturbance code of a combination locking device for preventing the lock from disturbance by an inadvertent rotation of the dial of the combination locking device.

BACKGROUND ART

Typical zipper locks vary in types. The latest type of zipper lock attached to the opening of a suitcase includes a casing having a locking mechanism operable in cooperation with a combination locking device in the casing and a pair of parallel slots on the top of the casing for receiving the tabs of a double zipper. The lock further includes a forward slidable button positioned between the slots to operate the locking mechanism for unlocking the tabs from the slots. This type of zipper lock is characterized by in its smooth operation rather than its complicated locking mechanism. Further, it can not prevent the code of the combination locking device from disturbance by of an inadvertent rotation of the dials.

SUMMARY OF INVENTION

The present invention has a main object to provide a zipper lock with a slidable button and non-disturbance code of combination locking device in which the slidable button is slid rearward and has a pair of parallel receiving slots formed in the top for receiving the tabs of a double zipper directly in the button and for simplifying the locking mechanism inside the casing.

Another object of the present invention is to provide a zipper lock with a slidable button and non-disturbance code of combination locking device in which the combination locking device includes an arrester member for arresting a slide from lateral movement relative to the casing so as to facilitate the changing of the code for the combination locking device and preventing the code from disturbance by an inadvertent rotation of the dials.

The present invention will become more fully understood by reference to the following detailed description thereof when read in conjunction with the attached drawings.

DETAILED DESCRIPTION OF THE PREFERRED EMBODIMENT

Figure 1:
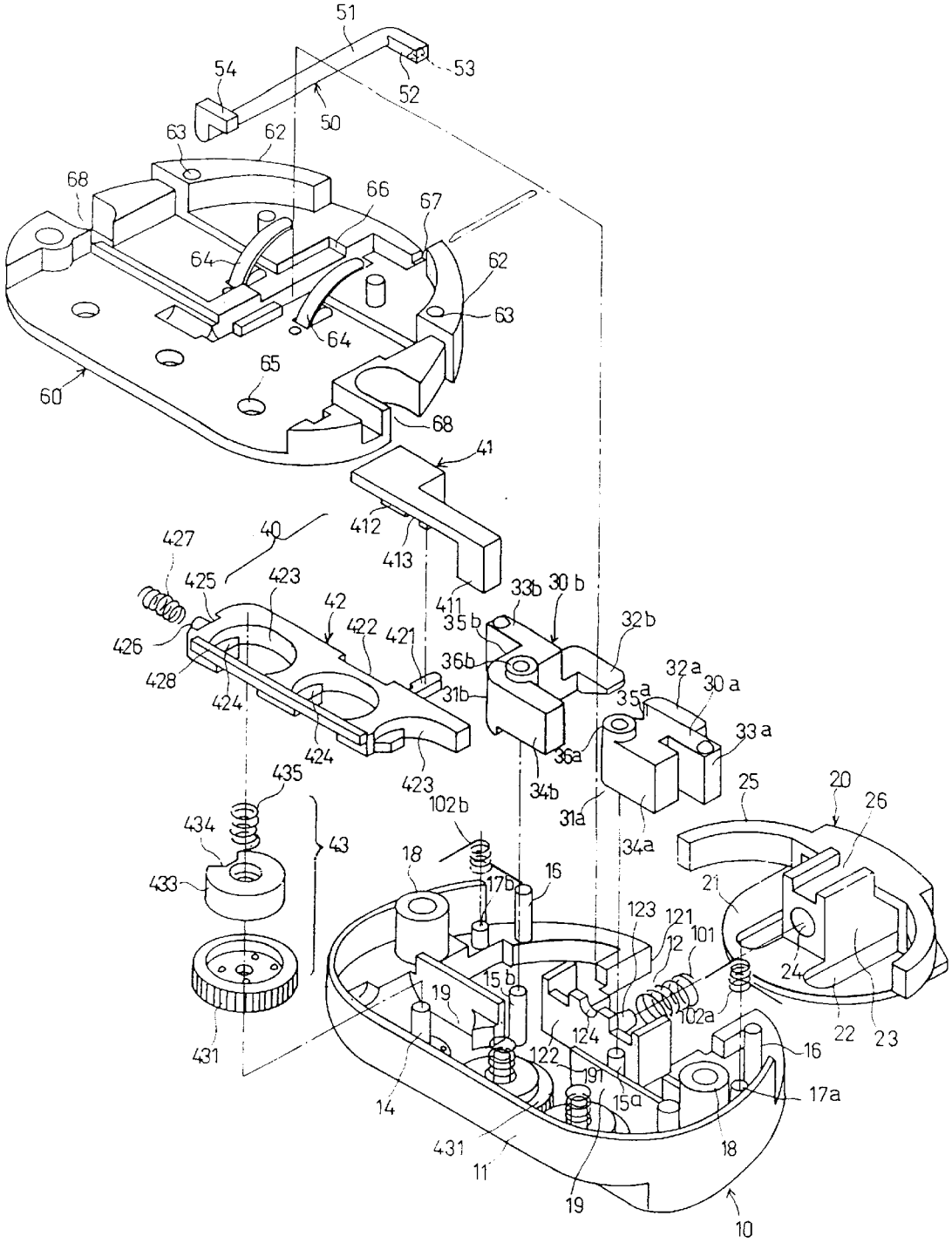
FIG. 1 is an exploded perspective view to show the preferred embodiment of the present invention.
Figure 2:
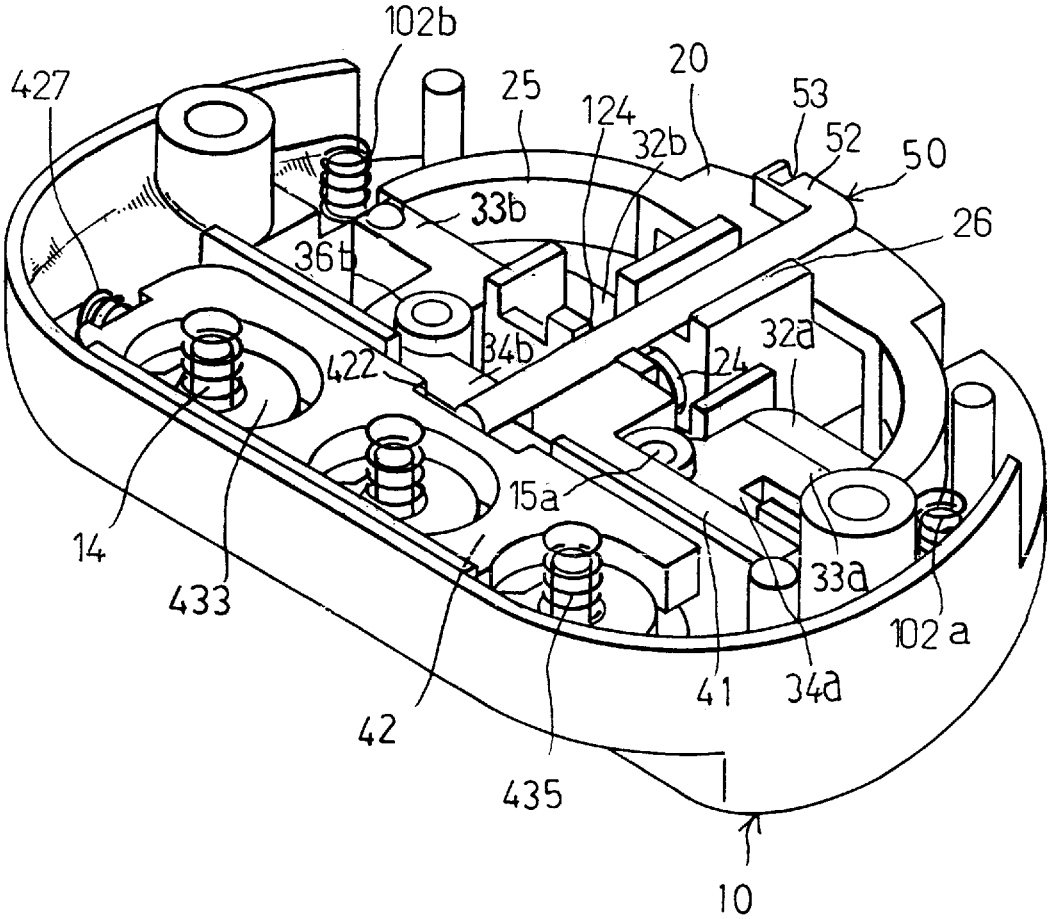
FIG. 2 is a perspective view to show an assembled zipper lock according to the present invention.

With reference to the drawings and intiating from FIGS. 1–2, the zipper lock of the present invention comprises generally a casing 10, a slidable button 20, a pair of first and second latch members 30*a* and 30*b*, a slidable locking mechanism 40, an arrester member 50 and a lid 60.

Figure 10:
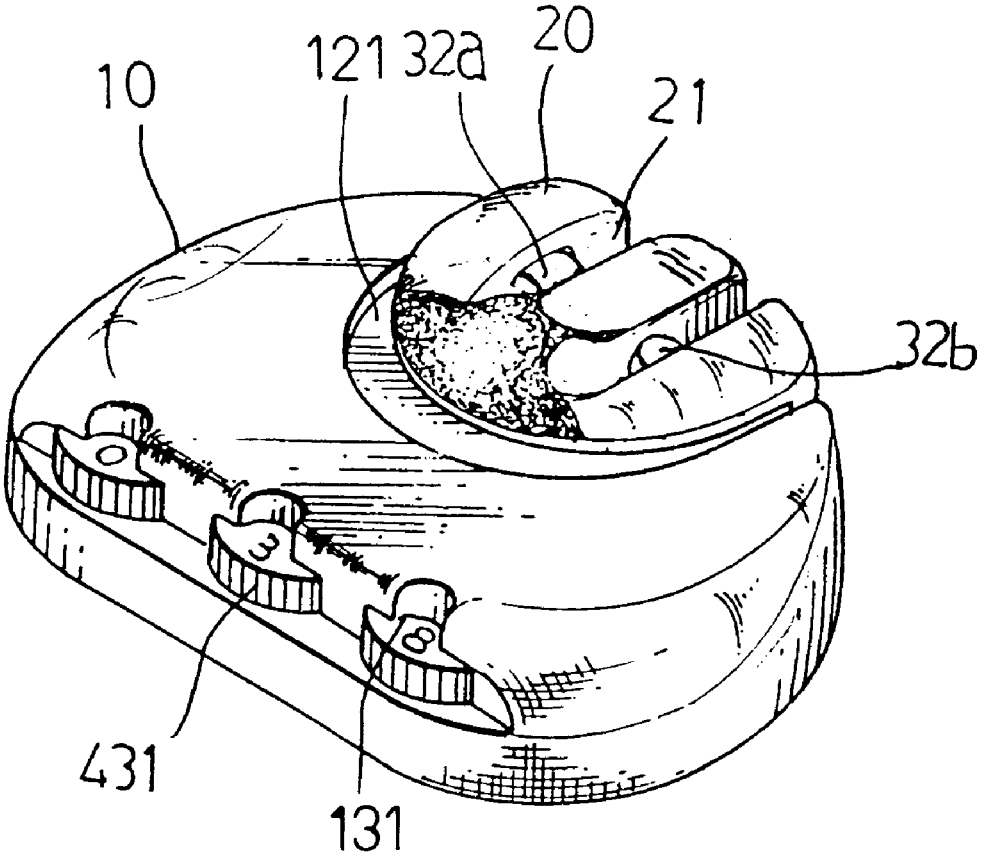
FIG. 10 is a perspective view to show the zipper lock of the present invention.

The casing 10 of a generally round forward end and a straight rearward end includes side walls 11 surrounding rearward side and a pair of lateral sides, an opening 12 centrally formed in forward end, a round slot 121 centrally formed on an outward surface of the casing 10 abutting the opening 12 (as shown in FIG. 10), an elongate depression 13 formed on the rearward end of the casing 10 along the straight rear side wall including a plurality of accesses 131 formed spaced apart through the upright wall of the depression 13, a plurality of pivots 14 spacedly projected downward from an inner surface of the casing 10 adjacent the recesses 131, a pair of first and second posts 15*a* and 15*b* spacedly projected downward from appropriate center parts of an inner surface of the casing 10, a pair of abutments 16 spacedly projected downward from a rearward end of a pair of roughly J-shaped extensions abutting the lateral side of the opening 12, a pair of third posts 17*a* and 17*b* spacedly projected downward from an inner surface of the lateral side of the casing 10 adjacent the abutments 16, a pair of coupling poles 18 spacedly projected downward from an inner surface of the casing 10 abutting the lateral side walls 11, a pair of rectangular extensions 19 transversely and spacedly extended from an inner surface of the casing 10 between the pivots 14 and the first and second posts 15*a* and 15*b* to define a space 191 therebetween and a U-shaped extension 122 projected downward from an inner surface of the casing 10 abutting the rearward end of the opening 12 including an axial rod 123 perpendicular to a forward surface of the transverse portion of the U-shaped and a semi-circular recess 124 centrally formed in the under side thereof.

The slidable button 20 includes a flat base 21 of a shape engageable into the opening 12 and the round slot 121, a pair of longitudinal slots 22 formed spaced apart through the center of the base 21, a rectangular projection 23 extended downward from a central surface of the base 21 between the slots 22 having a central bore 24 transversely formed in the rearward side slidably engageable with the axial rod 123 and biased with a first spring means 101 thereinbetween, a rectangular receiving space 26 in the underside, and an arcuate extension 25 projected downward along a forward side of the base 21 having two ends thereof extended to inside of the casing 10 engageble with the pair of abutments 16.

The first latch member 30*a* has a roughly U-shaped body 31*a* including a long lateral portion 33*a* and a short lateral portion 34*a* extended rightward relative to the casing 10 and perpendicularly connected by a transverse portion 35*a* of the U-shaped, a first axial tube 36*a* is vertically formed integral with an outer corner of the U-shaped body 31*a* between the short lateral portion 34*a* and the transverse portion 35*a* and a first L-shaped tongue 32*a* extended outward from a forward surface of the long lateral portion 33*a* of the U-shaped and toward left side relative to the casing 10. The second latch member 30*b* has a roughly Z-shaped body 31*b* including a first and a second extension 33*b* and 34*b* toward opposite sides and perpendicularly connected by a mediate portion 35*b*, a second axial tube 36*b* vertically formed integral with an inner corner between the second extension 34*b* and the mediate portion 35*b* and a second L-shaped tongue 32*b* extended outward from a forward surface of the first extension 33*b* and toward right side relative to the casing 10. The first latch member 30*a* is rotatably pivoted on a first post 15*a* with the left side thereof stopped against the right side of the U-shaped extension 122 and the free end of the long lateral portion 33*a* stopped against a free end of the arcuate extension 25 of the slidable button 20 and biased by a first leg of a second spring means 102*a* which is wrapped on a third post 17*a* and has a second leg biased against an inner surface of a lateral wall on the right side of the casing 10. The second latch member 30*b* is rotatably pivoted onto the first post 15*a* with right side of the mediate portion 35*b* stopped against a left side of the U-shaped extension 122 and the free end of the first extension 33*b* stopped against a free end of the arcuate extension 25 of the slidable button 20 and biased by a first leg of a second sing means 102*b* which is wrapped on a second post 15*b* and has a second leg biased against an inner surface of a lateral wall on the left side of the casing 10.

The slidable locking mechanism 40 is composed of a check member 41, a slide 42 and a combination locking device 43. The check member 41, has a roughly L-shaped body engageable into a space of the casing 10 between rectangular extension 19 and the first latch member 30*a* includes a first rectangular vertical protrusion 411 projected upward from a first end thereof engageable with the rearward side of the first latch member 30*a*, a second rectangular vertical protrusion 412 projected upward from a second end thereof engageable on rearward side with a forward side of the second latch member 30*b* and a longitudinal slot 413 formed in an upward surface of the second rectangular vertical protrusion 412. The slide 42 has a generally flat rectangular body engageable between the pivots 14 and the rectangular extensions 19 includes an actuator means 421 projected forward from a forward side thereof engageable into the longitudinal slot 413 of the check member 41, a first rectangular notch 422 formed in a forward side thereof adjacent the actuator means 421, a plurality of oval shaped recesses 423 formed spaced apart in the flat portion thereof each having a tapered projection 424 extended inward from a left periphery of the oval shaped recessed cylindrically-shaped, a pole 426 projected outward from a second rectangular notch 425 at a leftward end of the slide 42 and biased on a third spring means 427, the other end of the spring means 427 stopping against an inner surface of an extension adjacent the lateral wall on the left side of the casing 10 and an elongate member 428 extended along a rearward edge of the slide 42. The combination locking device 43 includes a plurality of dial members pivoted onto the plurality of pivots 14 and engageable into the oval shaped recesses 423 of the slide 42. Each of the dial members is each composed of a dial 431 accessible from the accesses 131 of the casing 10 and a slide 433 frictionally connected with the dial 431 and a tapered notch 432 formed in a circumference of the slide 433. When the dial members mount onto the plurality of pivots 14, a plurality of fourth spring means 435 respectively bias on the top of the pivots 14 to provide proper elasticity to the dial members.

The arrester member 50 is disposed in the semi-circular recess 124 of the U-shaped extension 122 and the rectangular receiving space 26 of the slidable button 20 and includes a cylinder body 51, a rectangular extension 52 perpendicularly connected with a first end having a longitudinal slot 53 relative to the body 51 formed adjacent the free end thereof and an L-shaped extension 54 perpendicular with a second end of the body 51 and keeping a right angle with the rectangular extension 52 therebetween. When the arrester member 50 is disposed in place into the casing 10, the rectangular extension 52 is toward the left side relative to the casing 10 and engaged with the underside of the arcuate extension 25, whereas, the L-shaped extension 54 thereof is embedded into a space between the rectangular notch 422 of the slide 42 and the U-shaped extension 122 (as shown in FIG. 2).

Figure 9:
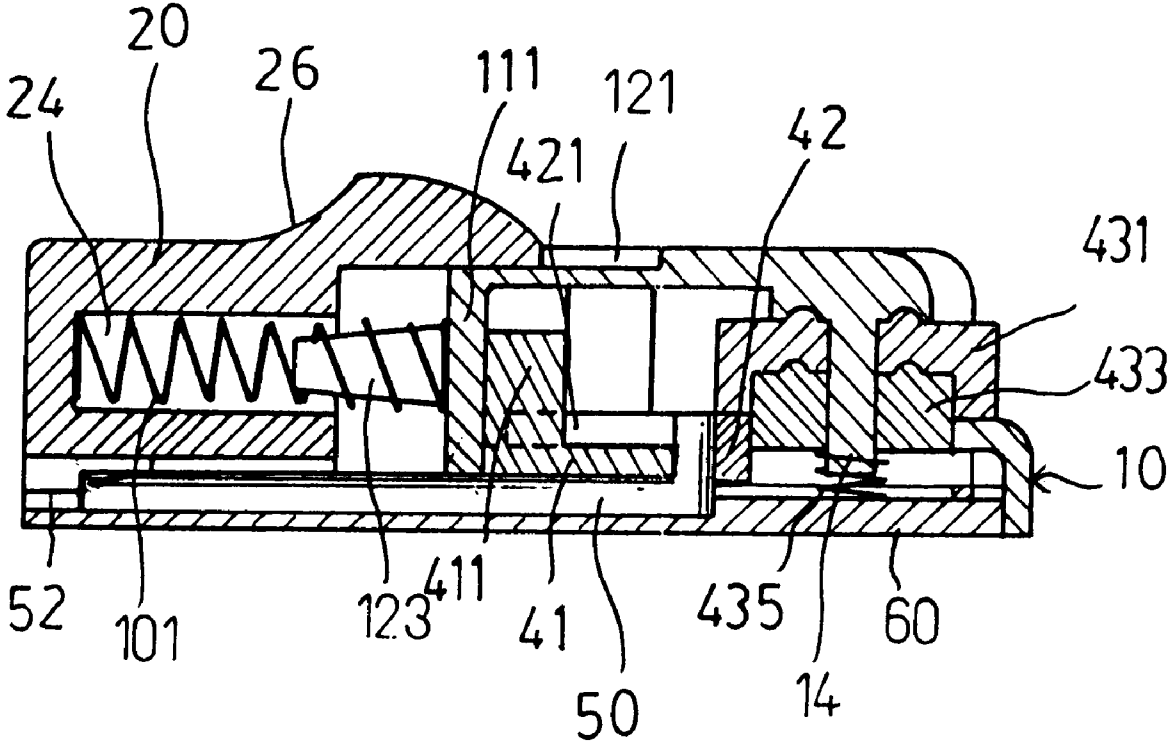
FIG. 9 is an elevational section of FIG. 2.

The lid 60 includes a flat base 61 of a shape engageable with the bottom of the casing 10, a pair of arcuate side walls 62 adjacent the forward end engageable with the arcuate extension 25 for confining the slidable button 20 within the casing 10, a pair of coupling holes 63 in the top of the side walls 62 for engaging with the pair of abutments 16, a pair of longitudinal spring plates 64 disposed parallel to a proper inner surface engageable with the pair of longitudinal slots 22 of the slidable button 20 for ejecting the tabs of a double zipper when it engages into the slots 22, a plurality of circular holes 65 formed spaced apart adjacent the straight rearward end for engaging with the plurality of pivots 14 therein with the fourth spring means 435 biased thereinbetween, a longitudinal slot 66 centrally formed in the base 60 for engaging partially the arrester member 50 therewithin, a small notch 67 formed in a forward. end made in registry with the slot 53 for facilitating the ability to rotate the rectangular extension 52 turning an angle of about 60 degrees, and a pair of lateral slots 68 made engageable with the coupling poles 18. When the lid 60 is completely engaged in place with the casing 10, a plurality of fastening means such as screws are employed. FIGS. 9 and 10 show an assembled zipper lock of the present invention.

Figure 3:
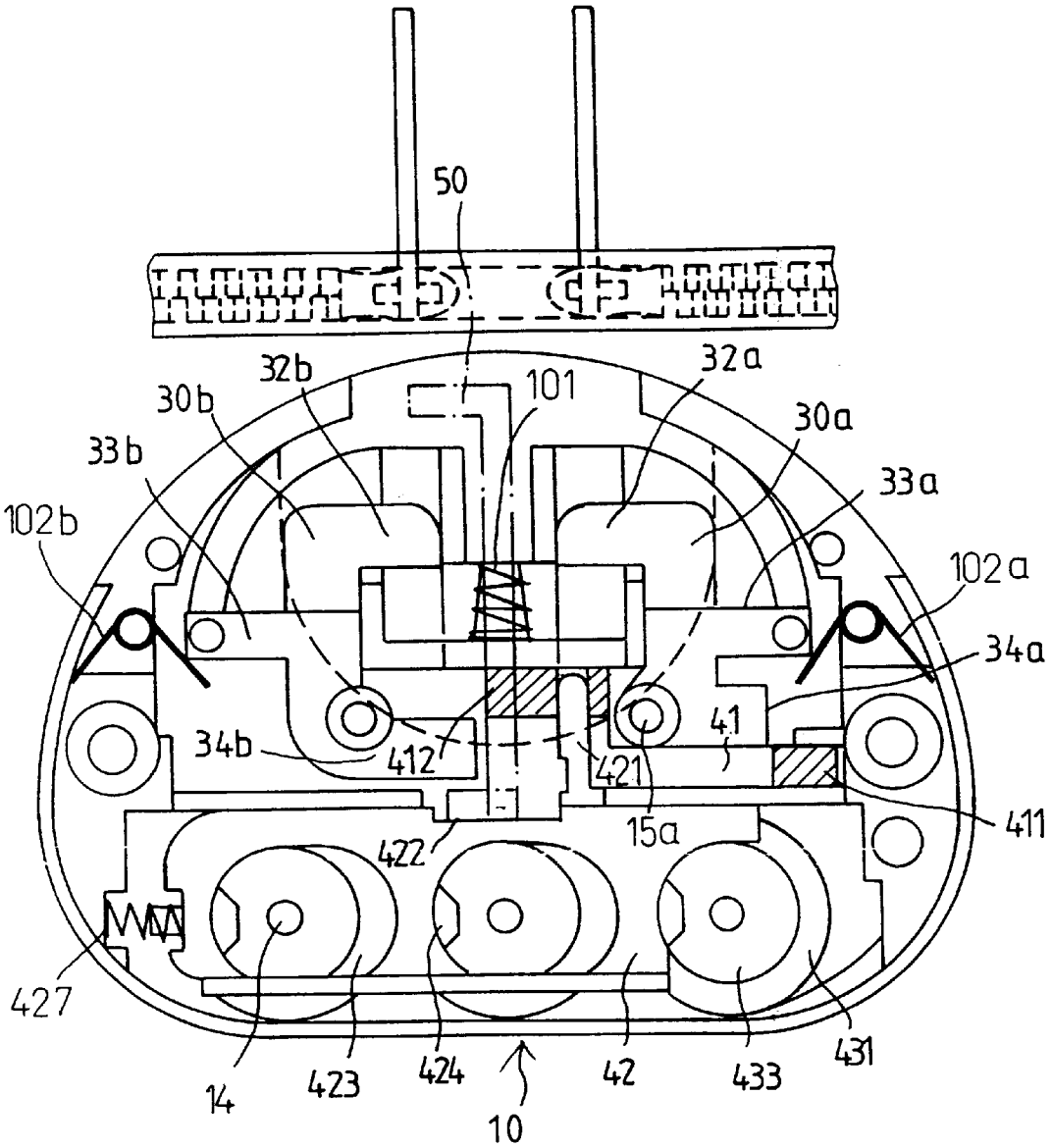
FIG. 3 is a plane view of FIG. 2 showing that the combination locking device is in state of combination while the tabs of a double zipper are about to be locked up in the slots of the slidable button.
Figure 4:
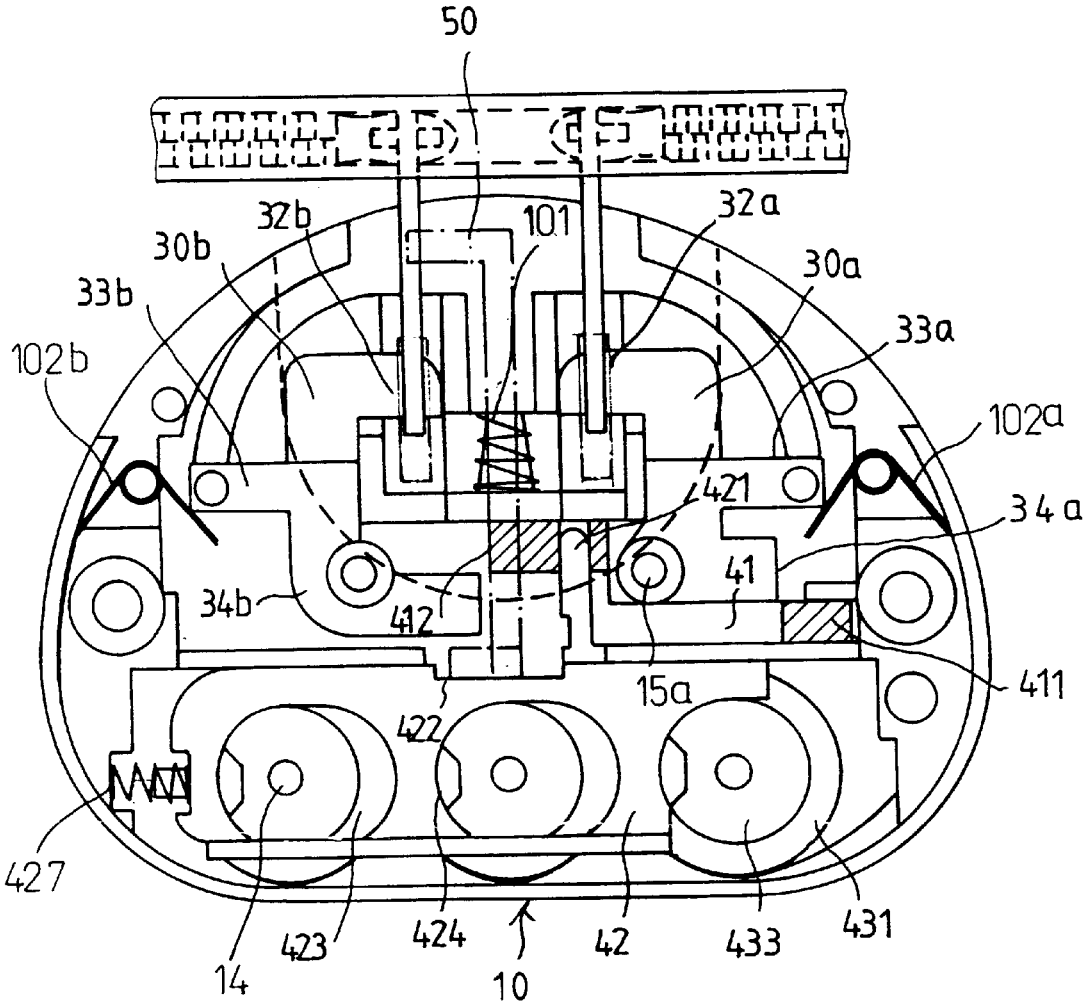
FIG. 4 is a plane view of FIG. 2 while the tabs of the double zipper are locked up in place into the slots of the slidable button.
Figure 5:
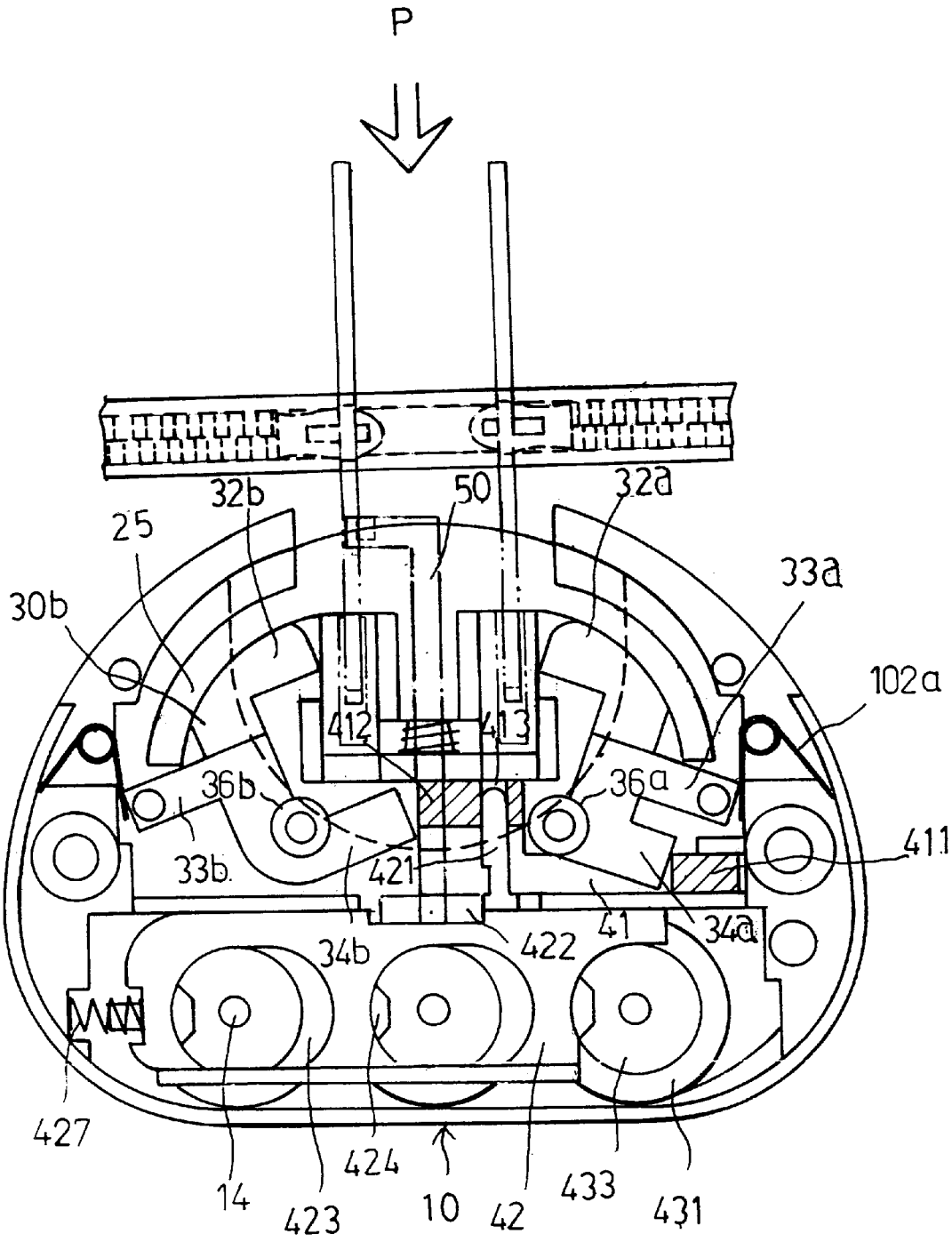
FIG. 5 is a plane view of FIG. 2 while the tabs of the double zipper are unlocked from the slots of the slidable button.
Figure 6:
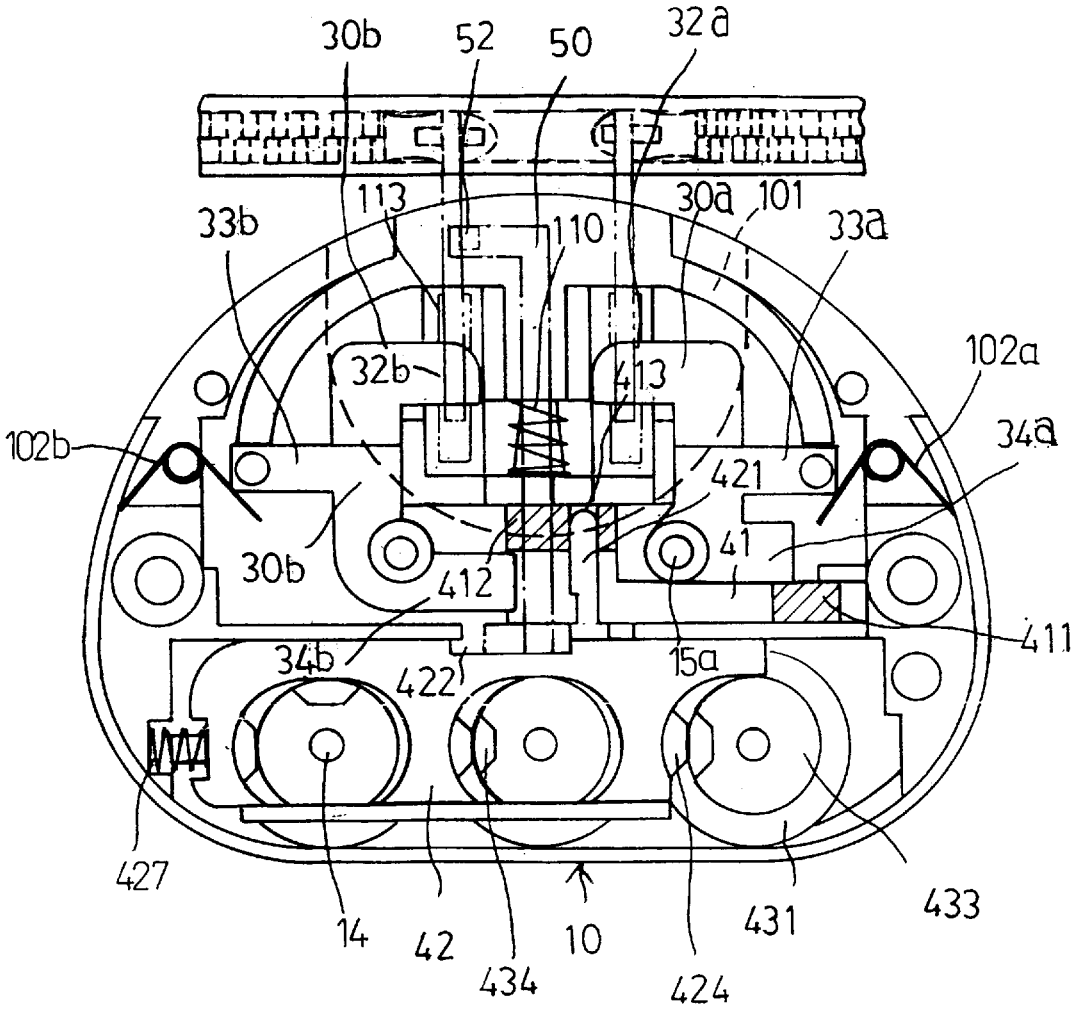
FIG. 6 is a plane view of FIG. 2 indicating that the combination locking device is disordered while the locking mechanism is in a locking position.
Figure 7:
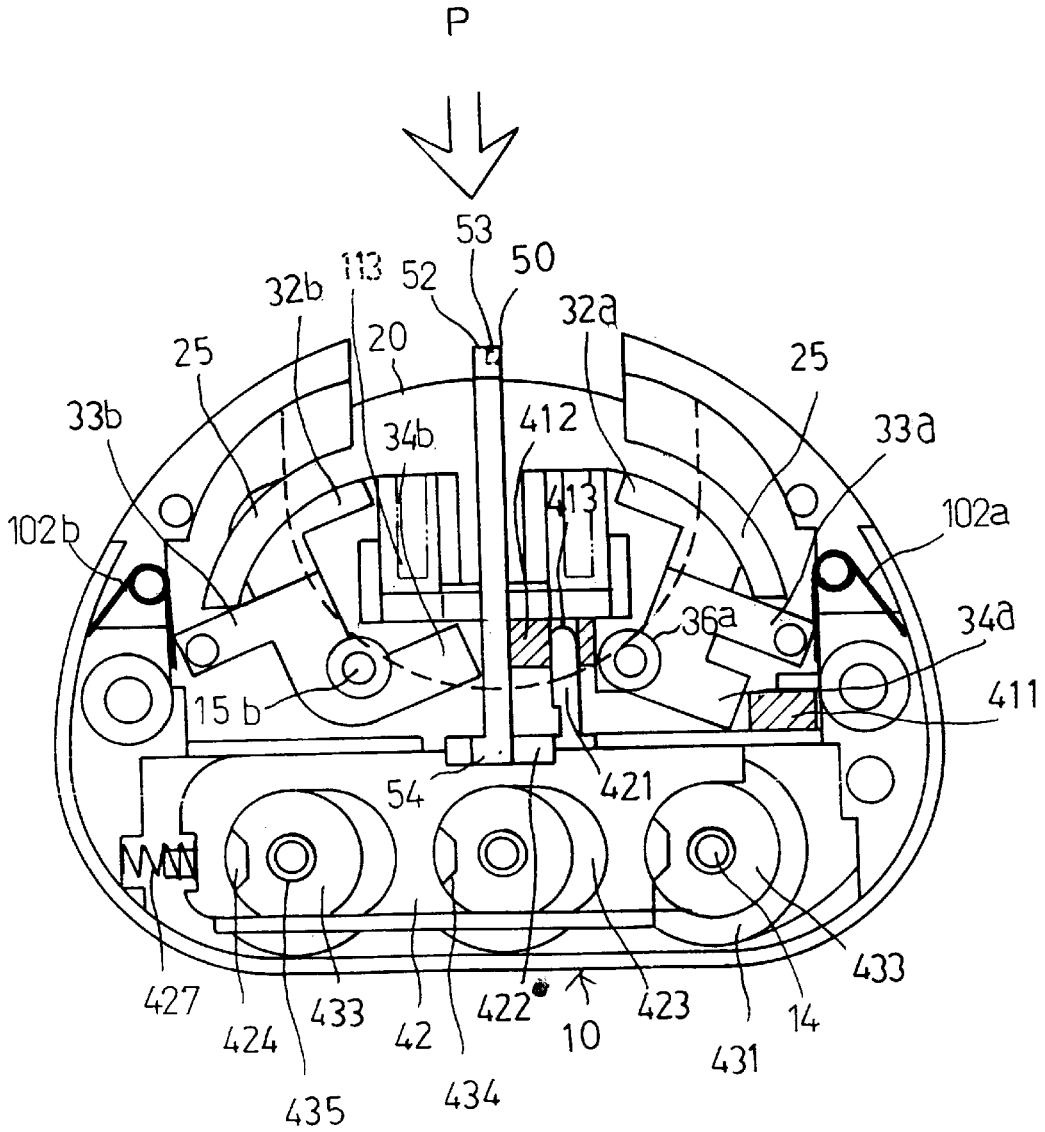
FIG. 7 is a plane view of FIG. 2 indicating that the arrester member is turned to arrest the slide from lateral movement while the dials can be rotatable to change the code of the combination locking device.
Figure 8:
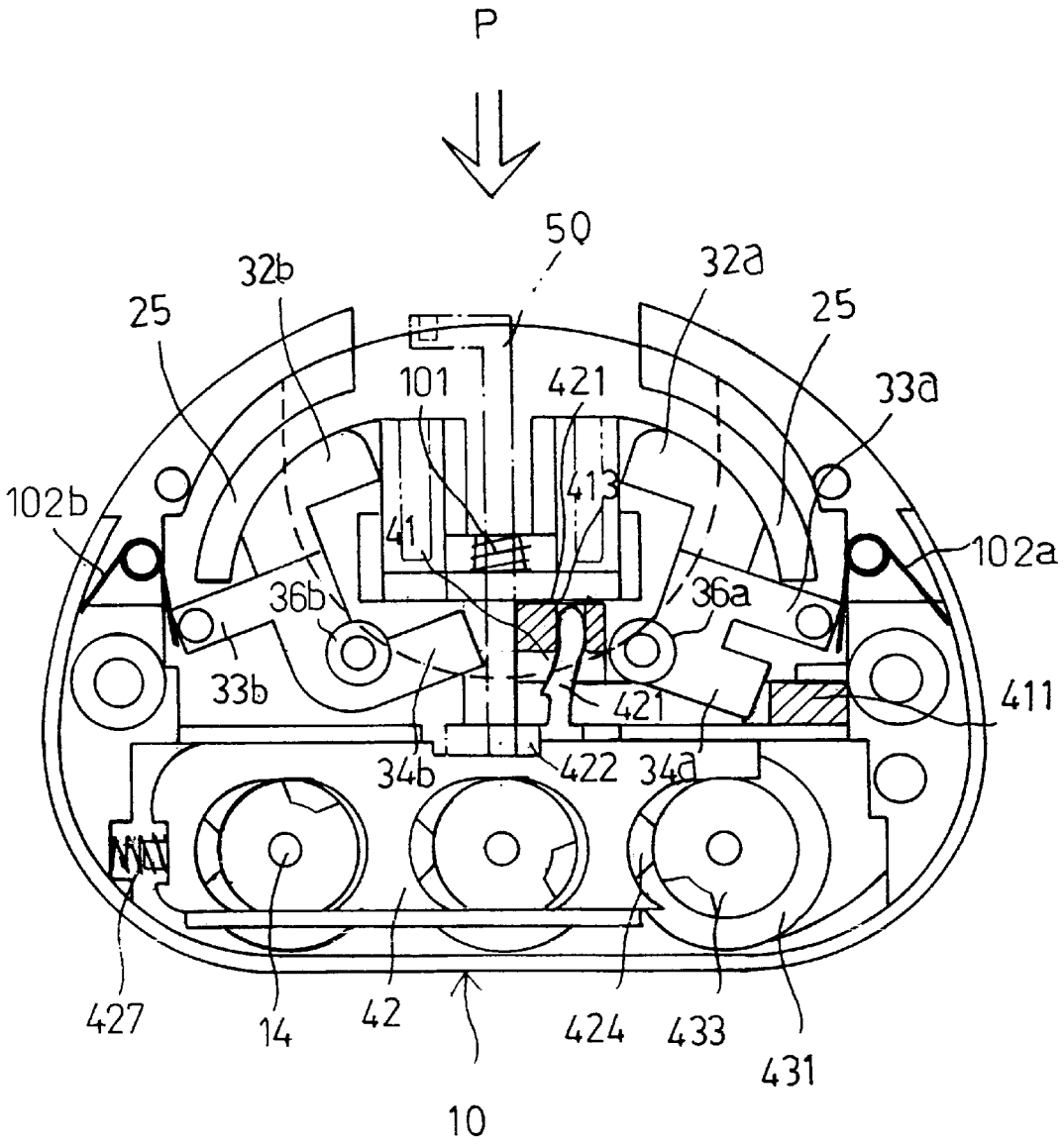
FIG. 8 is a plane view of FIG. 2 indicating that the slide is movable while the dials are not rotatable to change the code.

Referring to FIGS. 3 to 8 of the drawings, in operation, FIG. 3 shows that the tapered projections 424 are engaged into the tapered notches 432 indicating that the combination locking device 43 is in the state of combination. So that the slide 42 is moved rightward relative to the casing 10 by the resilient force of the third spring means 427 and its actuator means 421 in turn actuates the check member 41 moving rightward in concert with so as to disengage with the second extension 34*b* of the second latch member 30*b* and the rearward side of short lateral portion 34*a* of the first latch member 30*a* respectively. Meanwhile, both the first and second latch members 30*a* and 30*b* are rotatable and ready to lock up the tabs of the zipper. FIG. 4 shows that the tabs of the zipper are locked up where the combination locking device 43 is still in the state of combination. Because the tongues 32*a* and 32*b* of the latch members 30*a* and 30*b* have their sloped upper surfaces so that when the tabs apply a slight pressure on the tongues 32*a* and 32*b*, they will first move outward of the longitudinal slots 22 and permit the tabs to move further downward. However, when the tabs reach to a position where their eyes are engageable with the tongues 32*a* and 32*b*, the tongues 32*a* and 32*b* may be returned back into the slots 22 and inserted into the eyes of the tabs under resilient force of the second spring means 102*a* and 102*b*, thus the tabs are locked up. This time, if the slidable button 20 is slid rearward relative to the casing 10, the free ends of the arcuate extension 25 press the first and second latch members 30*a* and 30*b* to rotate rearward to disengage their tongues 32*a* and 32*b* with eyes so that the tabs of the zipper are ejected by the spring plates 64 out of the slots 22. Therefore the zipper lock is unlocked (as shown in FIG. 5). When the button 20 is released, both the button 20 and the latch members 30*a* and 30*b* immediately turn back to their original positions under the resilient forces of the first and second spring means 101 and 102*a* and 102*b* (as shown in FIG. 3). FIG. 6 shows that any one of the tapered projections 424 disengaged with the tapered notch 434 will make the combination locking device 43 become disturbed so that the slide 42 in concert with the check member 41 moves leftward relative to the casing 10 and the vertical extensions 411 and 412 are engaged with the first and second latch members 30*a* and 30*b* so as to check the latch members 30*a* and 30*b* from any rotation. This time, even the slidable button 20 is checked from slidable movement. Thusly lock is completely locked up and could not unlock unless the combination locking device 43 becomes into state of combination again. FIG. 7 shows that the zipper lock is in the state of combination. This time, if the user wants to change the original code into a desired code, the user should slide the slidable button 20 rearward and simultaneously stir the longitudinal slot 22 with a appropriate picker means to turn the rectangular extention 52 of the arrester member 50 counterclockwise for about 90 degrees so as to check the forward end of the button 20 and prevent the button 20 from returning to its original position, meanwhile, the L-shaped extension 54 of the arrester member 50 becomes engageable with the rectangular notch 422 preventing the slide 42 from moving leftward relative to the casing 10. Thus the combination locking device 43 constantly remains in state of combination and can not be disordered. Then, the user can frictionally rotate the dials 431 alone to rearrange a desired code for himself without moving the slides 433. Once the code is changed, the user then turns the rectangular extension 52 of the arrester member 50 clockwise to its original position to release the slidable button 20 back to its original position. The L-shaped extension 54 embeds into the casing 10 again and the zipper lock of the present invention is therefore back to its normal condition. FIG. 8 shows that if the first and second latch members 30*a* and 30*b* are rotated by rearward sliding of the slidable button 20 to disorder the combination locking device 43, the first and second vertical extensions 411 and 412 of the check member 41 are prevented by the short lateral portion 34*a* of the first latch member 30*a* from moving leftward in concert with the slide 42 because of the flexibility of the actuator means 421 and because of that the frictional attachment between the dial 431 and the slide 433 is stronger than the resilient force of the third spring means 427, so that the rotation of the dials 431 will force the slide 433 to rotate in concert with and the slide 42 will be forced to move leftward individually. It is impossible to change the code at this moment and the zipper lock of the present invention has a function to obviate any attempt at disturbance of the code by intentional or inadvertent rotation of the dials 431.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A zipper lock for locking tabs of a double zipper comprising:

a slidable button;

a casing having a round forward end and a straight rearward end and a side wall surrounding said rearward end and lateral sides, said casing has an opening in a center of said forward end, said opening has a round slot on an upper surface thereof for slidably engaging said slidable button therein, said casing has an elongate depression in a top of said casing along said straight rearward end, said casing has an access to said elongate depression through an upright wall of said casing;

a dial member;

a pivot means projects from and is spaced apart from an inner surface of said casing adjacent said access, said pivot means for pivoting said dial member, said dial member being accessible from said access;

a first post and a second post spaced apart and projecting outwardly from a central inner surface of said casing, said first and second posts rotatably engage first and second latch members respectively;

a first rectangular extension and a second rectangular extension spaced apart and extending along said inner surface of said casing between said pivot means and said first and second posts so as to define a first positioning space between said pivot means and said first and second rectangular extensions, said first positioning space slidably receiving a slide therein, said second rectangular extension and said second post define a second positioning space therebetween, said second positioning space slidably receiving a check member therein;

a U-shaped extension extending downwardly from said central inner surface of said casing, said U-shaped extension having a semi-circular recess centrally formed in a top of a transverse portion of said U-shaped extension for movably receiving a portion of an arrester member therein;

an axial rod centrally projected forward of said casing from a forward side of said transverse portion of the U-shaped extension, said axial rod slidably engaging a cavity of said slidable button with a first spring biased therebetween;

a pair of third posts spaced apart and projecting symmetrically from an extension abutting said lateral sides of said casing, said pair of third posts having a pair of springs mounted respectively thereon;

a pair of abutments spaced apart and symmetrically projecting from a generally J-shaped extension adjacent said pair of third posts;

a lid;

a plurality of tubular couplings spaced apart and symmetrically projecting so as to abut said lateral sides of said casing adjacent said third posts so as to couple said casing to said lid, said slidable button adapted to receive a pair of tabs of the double zipper, said arrester member being interactive with said slidable button so as to check a sliding action of said slidable button.

2. The zipper lock of claim 1, said dial member comprising a dial;

a slide frictionally engaged into said dial, said slide having a tapered notch in a circumference thereof; and a spring received in said tapered notch and in resilient relationship with said dial.

3. The zipper lock of claim 1, wherein said slidable button has a flat base with a shape engageable into said opening and into said round slot of said casing, said slidable button having a pair of longitudinal slots spaced apart and in parallel relationship, said pair of longitudinal slots extending through a center of said flat base so as to receive the tabs of the zipper therein, said slidable button has a rectangular projection extending downwardly from a center of said flat base between said pair of longitudinal slots, said rectangular projection has a central base formed transversely in a rearward side thereof, said central base slidably engaging said axial rod of said U-shaped extension with said first spring biasing there between, said slidable button has a rectangular receiving space centrally defined in an underside thereof, said rectangular receiving space movably receiving a portion of said arrester member therein, said slidable button having an arcuate extension projected downward along a forward side thereof, said arcuate extension having two ends extending into said casing and engagable with said pair of abutments.

4. The zipper lock as claimed in claim 3, wherein said first latch member has a U-shaped body having a long lateral portion and a short lateral portion connected through transverse portion, said first latch member having a tongue extending outward from a forward side of said long lateral portion, said first latch member has a first axial tube integrally formed in a vertical orientation with an outer corner between said short lateral portion and said transverse portion, said first axial tube for pivoting said first latch member onto said first post such that said long lateral portion stops against one end of said arcuate extension of said slidable button.

5. The zipper lock of claim 4, wherein said second latch member includes a body having a first extension and a second extension, said second latch member has a tongue extending outwardly from a forward side of said first extension, said second latch member has an axial tube extending in a vertical orientation and formed integral with an inner corner between said second extension and the transverse portion so as to allow the pivoting of the second latch member onto said second post such that said first extension stops against another end of said arcuate extension of said slidable button.

6. The zipper lock of claim 5, said slide comprising a flat rectangular body, an actuator means projected outward from a forward edge of said rectangular body, a first rectangular notch formed centrally in a forward edge of said rectangular body adjacent said actuator means, and at least one oval-shaped recess having a tapered projection projecting inwardly from a periphery thereof for engaging said dial member.

7. The zipper lock of claim 6, wherein said check member comprises an L-shaped body, a first rectangular vertical extension projecting upward from a first end thereof and engageable with said short lateral portion of said first latch member, said check member further comprising a second rectangular vertical extension projecting upward from a second end thereof and engageable with said second extension of said second latch member, said second rectangular vertical extension having a longitudinal slot in an upper surface thereof so as to be engageable with said actuator means of said slide.

8. The zipper lock of claim 7, wherein said arrester member comprises a cylindrical body, a rectangular extension extending perpendicular to a first end thereof, and an L-shaped extension extending perpendicular to a second end thereof so as to form a right angle with said rectangular extension, said L-shaped extension being selectively engageable with said first rectangular notch of said slide.

9. The zipper lock of claim 8, said lid comprising a flat base of a shape engageable with said casing, a pair of arcuate side walls adjacent said forward end of said casing so as to confine said slidable button within said casing, said lid has a pair of coupling holes in a top of said arcuate side walls for coupling with said abutments of said casing, said lid further comprises a pair of longitudinal spring plates disposed in parallel relationship to an inner surface of said casing and engageable with said pair of longitudinal slots of said slidable button, said lid having a longitudinal slot extending between said spring plate so as to receive a portion of said arrester member therein, said lid having a small notch in a forward edge thereof for accessing said arrester member from exterior of said casing, said lid having a circular hole adjacent said rearward end so as to engage said pivot means of said casing, said lid having a plurality of coupling slots with lateral edges thereof engageable with said coupling holes of said casing so as to couple said lid onto said casing.

* * * * *